US005554262A

United States Patent [19]

Turner

[11] Patent Number: 5,554,262

[45] Date of Patent: Sep. 10, 1996

[54] LASER CURTAIN EDGE TRACKING SYSTEMS FOR PAPERMAKING MACHINES

[75] Inventor: John S. Turner, Rochester, N.H.

[73] Assignee: Wangner Systems Corp., Greenville, S.C.

[21] Appl. No.: 272,808

[22] Filed: Jul. 11, 1994

[51] Int. Cl.[6] ..... D21F 11/00; G01V 9/04

[52] U.S. Cl. ..... 162/198; 162/263; 162/252; 356/375; 356/385; 242/417.3; 226/20

[58] Field of Search ..... 162/263, 252, 162/262, 273, 272, 198, 199; 242/417.3, 418.1, 419.1; 356/375, 376, 385, 386, 387; 250/561, 548; 271/226; 226/20, 77, 88, 100

[56] References Cited

U.S. PATENT DOCUMENTS

| | | | |
|---|---|---|---|
| 3,380,637 | 4/1968 | Knapp | 226/20 |
| 3,570,735 | 3/1971 | Kurz | 226/18 |
| 4,077,579 | 3/1978 | Seleski et al. | 242/57.1 |
| 4,303,189 | 12/1989 | Wiley et al. | 226/15 |
| 5,087,313 | 2/1992 | Duecker | 156/271 |
| 5,117,100 | 5/1992 | Yoshida et al. | 250/221 |

OTHER PUBLICATIONS

"Industrial Applications of Laser" by John F. Ready, Academic Press 1978, Chapters 10 & 12.

"Using optical techniques to align paper machines" by Timothy Puntin, Tappi Journal, May 1987, pp. 179–181.

*Primary Examiner*—Donald E. Czaja

*Assistant Examiner*—Jose A. Fortuna

*Attorney, Agent, or Firm*—Henry S. Jaudon; Cort Flint

[57] ABSTRACT

An edge tracking apparatus for maintaining a continuous circulating papermaking fabric in an aligned position as it moves through a papermaking machine. The edge tracking apparatus includes a pivotally mounted guide roll and a laser scanner. The laser scanner, which produces a laser screen, is positioned relative to an edge of the papermaking fabric so that the edge bisects the laser screen. A controller is connected with the laser scanner. The controller acts to receive signals from the laser scanner in response to transverse movement of the edge of the papermaking fabric and to convert those signals into control signals which activate a drive in the steering apparatus. The drive shifts the longitudinal position of the guide roll causing it to steer the papermaking fabric back into its aligned position. A recording unit is also connected with the controller and is controlled to plot the position of the edge during operation of the papermaking machine.

14 Claims, 3 Drawing Sheets

LASER CURTAIN EDGE TRACKING SYSTEMS FOR PAPERMAKING MACHINES

BACKGROUND OF THE INVENTION

This invention is directed to a edge tracking system for use with papermaking machines for maintaining the papermaking fabric aligned during its circulating motion through the papermaking machine and for recording the position of the papermaking fabric during operation of the machine. The tracking system is particularly intended for use in a paper forming section of a papermaking machine, although it is in no way limited to this section, and could well find utility with press machines or drying machines.

In papermaking, continuous porous fabrics are circulated through the papermaking machines along a single vertical plane, but through a plurality of horizontal planes. One of these horizontal planes is designated the forming area and it is in this area that the paper forming pulp of dilute fiber is deposited onto the papermaking fabric. The dilute fiber suspension, consisting of water and 0.2 to 1.0% solids, is discharged at speeds up to 6000 ft/min. on to the moving forming fabric which is moving at a fiber discharge speed of ±30 feet/minute. The water is removed by suction through the porous papermaking fabric to form a paper sheet on the surface thereof. The water removal, which results in fiber reorientation, continues until the consistency of the paper forming pulp reaches 20–25% solids.

Due to these high speeds, it has become increasingly important that the papermaking fabrics be maintained aligned as it circulates through the papermaking machine.

In the past, alignment has been carried out mainly by hand using the tensioning apparatus of the papermaking machine. Such a device is disclosed in U.S. Pat. No. 2,918,970 ('970).

There have been attempts to utilize such type devices along with an edge contracting paddle. In this arrangement a pivoted paddle is positioned to engage the moving edge of the papermaking fabric. Transverse movement of the edge moves the paddle about a pivot which actuates an electromechanical device. The electromechanical device then initiates movement of a bearing assembly carrying one end of a papermaking fabric supporting roll. This arrangement lacks the facility of making instantaneous responses and the ability for making minute adjustments is limited. Also, the paddle presents the problem of edge wear which could cause unraveling and thereby shorten the life of the papermaking fabric. Finally, there is a tendency for the pivot arm to stick and fail to react to edge movements.

Accordingly, it is an object of the instant invention to provide an edge tracking system which provides instantaneous response to misalignment of the papermaking fabric.

Another object of the invention is to provide an edge tracking system which is sensitive to minute misalignments of the papermaking fabric.

Another object of the invention is the provision of an edge tracking system which monitors the position of the papermaking fabric, but does not physically contact the fabric.

Another object of the invention is to provide a tracking system including a recording mechanism which operates to plot the position of the papermaking fabric during operation of the papermaking machine.

Another object of the invention is to provide an edge tracking system having an edge sensor which operates without mechanical movement and is effective to detect minute movement.

Another object of the invention is to provide a laser scanner producing a laser curtain having parallel edges for use with a papermaking machine.

SUMMARY OF THE INVENTION

The above objectives are accomplished according to the invention by providing an edge tracking system for use with a papermaking machine. Papermaking machines are constructed to have a plurality of rotating rolls which are adapted to support and drive a continuous papermaking fabric. These rolls are arranged to be transverse to the longitudinal direction of movement of the papermaking fabric. The rolls are arranged with their axis of rotation in parallel relationship. The edge tracking system acts to determine and maintain the position of a longitudinal edge of the papermaking fabric relative to a desired longitudinal position.

The steering device includes a guide roll which is arranged with its longitudinal axis normally parallel with the longitudinal axis of the supporting and driving rolls. The guide roll is carried by a mounting device which is capable of axially adjusting the longitudinal axes of the guide roll relative to the longitudinal axis of the supporting and driving rolls.

The tracking system includes an edge sensing device which is operative to detect the position of a longitudinal edge of the papermaking fabric relative to a desired longitudinal position. The edge sensing device is operative to generate electrical signals upon sensing movement of the longitudinal edge of the fabric away from the desired longitudinal position. These signals are converted to activate a drive which in turn moves the longitudinal axis of the guide roll. By angularly adjusting the longitudinal axis of the guide roll relative the longitudinal axis of the direction of movement of the papermaking fabric, the fabric edge is maintained in register with the desired position.

The steering device includes a guide roll over which the paper forming fabric passes during its movement through the paper forming machine. A mounting structure mounts the guide roll for angular displacement and a drive which is connected, with the mounting structure, is selectively operable to displace the guide roll.

The tracking system includes a recording unit which is operative to record and plot the linear position of the longitudinal edge of the papermaking fabric during operation of the papermaking machine.

The tracking system also includes a controller which is adapted to receive electrical signals generated by the sensor and, in turn, to produce control signals operative to activate the drive of the steering device to displace the guide roll sufficiently to steer the fabric edge into a desired alignment. The controller also simultaneously produces a second control signal in response to the signals from the sensor which activates the recording unit to graphically record the position of the papermaking fabric during its continuous movement through the papermaking machine.

The sensor includes a laser scanner having a transmitter which emits a laser curtain having spaced parallel edges. The laser curtain is received by a receiver. The fabric edge is normally located intermediate the laser curtain. Lateral movement of the fabric edge alters the quantity of light received and any change in the quantity of light received by the receiver produces a corresponding change in voltage output.

A controller receives the voltage output from the receiver. A decrease in voltage causes the controller to initiate movement of the guide roll in a first direction. An increase in received voltage causes the controller to initiate movement of the guide roll in the opposite direction.

The continuous papermaking fabric circulates through the paper forming machine moving from the front end over the forming section to the rear end. From the rear end the papermaking fabric runs beneath the forming section as it returns to the front end. The sensor is normally arranged along the return run of the papermaking fabric, however, in certain instances it may be arranged along the forming section of the paper forming machine.

The continuous paper forming fabric contacts with the guide roll with a wrap of between 25° and 75°.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
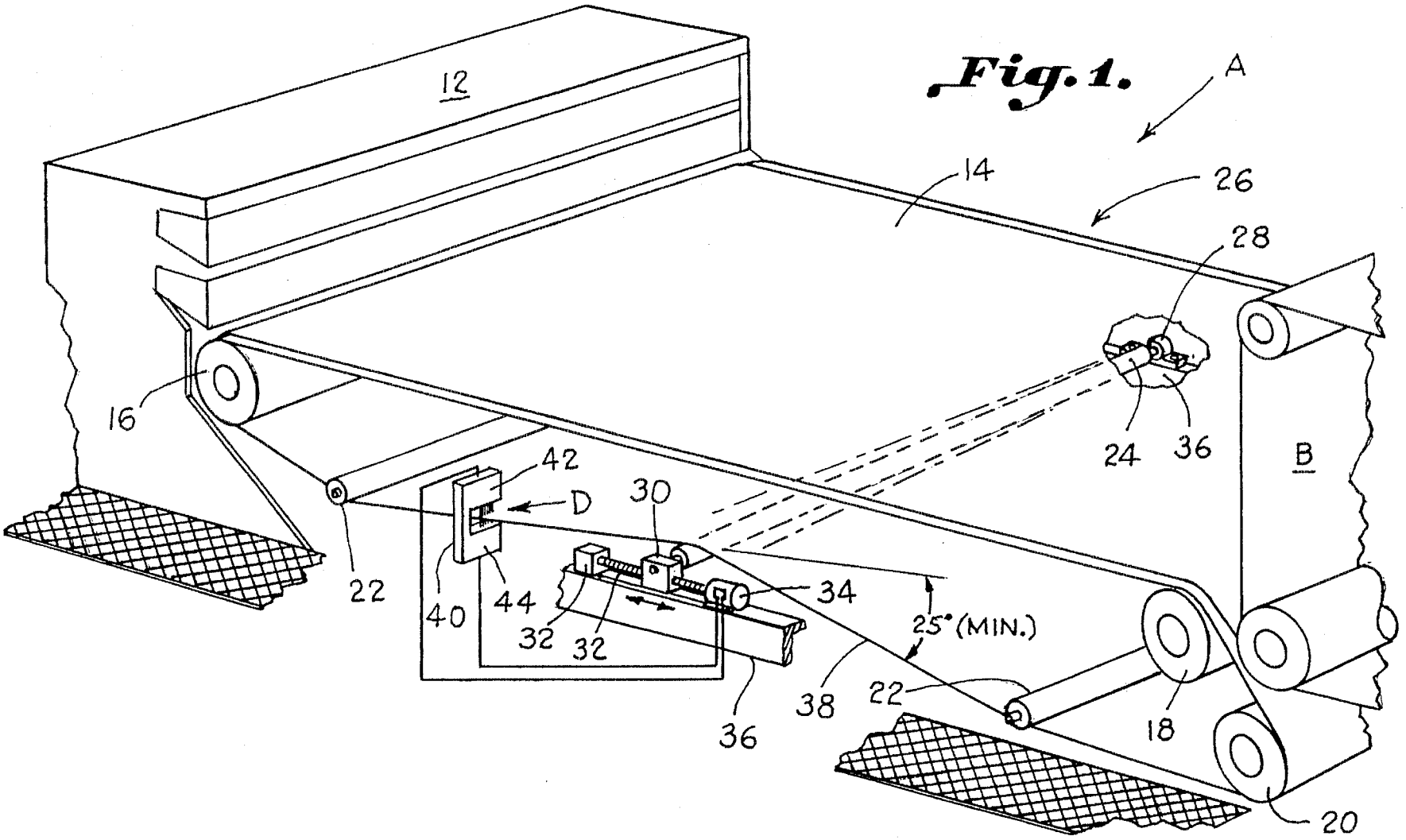
FIG. 1 is a sectional perspective view showing a papermaking machine incorporating the steering device of the invention.
Figure 5:
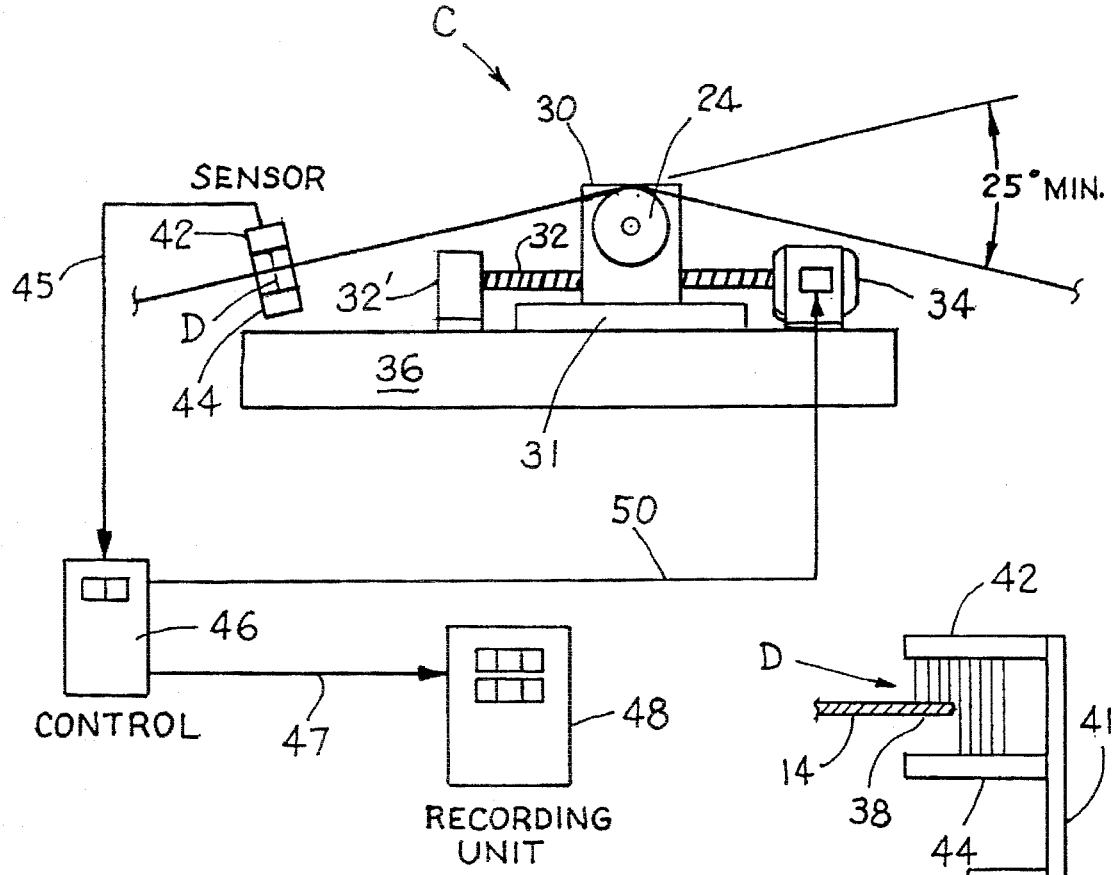
FIG. 5 is a sectional side view showing the sensing arrangement of the invention.

Referring now to FIGS. 1 and 5, there is shown a partial cutaway view of a papermaking machine which is designated A. Papermaking machine A includes headbox 12 which receives paper forming pulp and is arranged adjacent the forward end of the machine. A papermaking fabric 14 is supported and driven by breast roll 16, couch roll 18, drive roll 20, idler rolls 22 and guide roll 24. Papermaking fabric 14 passes beneath head box 12 where it receives the paper forming pulp. Papermaking fabric 14 then passes through the dryer section 26 of the papermaking machine where a series of suction boxes and vacuum boxes extract the water or fluid from the pulp leaving the paper forming fibers on the support surface of papermaking fabric 14. The sheet of paper forming fibers, after passing through the dryer section, are removed from papermaking fabric 14 and passed on to the press section B where the paper forming fibers are further processed.

Papermaking fabric 14, which is continuous, circulates through papermaking machine A passing from drying section 26 over couch roll 18, drive roll 20 and returns to the front end of the machine. During the return run, papermaking fabric 14 passes beneath dryer section 26 and is controlled by idler rolls 22 and guide roll 24.

In modern papermaking machines, speeds of up to 6000 ft/min. are common. Also, as the papermaking fabric passes through dryer section 26, the various suction and vacuum devices, during their dewatering activities, draw the fabric against their upper surfaces with considerable force. When the fabric is misaligned, the water is not evenly removed. Also, the fabric is subjected to accelerated wear and stretching. For these reasons, it is extremely important that the papermaking fabric be accurately aligned transversely of dryer section 24 and support and drive rolls 16, 18, 20, 22, 24 during its movement through the papermaking machine.

In the past, fabric alignment was normally carried out by using tensioning apparatus such as that illustrated in the '970 patent. These devices are primarily constructed to allow slack so that a new endless papermaking fabric may be positioned about the support and drive rolls in the machine. These tensioning devices are normally incorporated as tensioning rolls but in some instances, are combined with one of the end rolls. In either case, once the papermaking fabric is in place, the tension rolls are activated to tighten it in position. As discussed in '970 patent, it is desired that equal tension be maintained across the fabric width and that a desired tightness be maintained.

In the instant arrangement, an edge tracking system C is incorporated with papermaking machine A. Tracking system C incorporates a steering apparatus which includes a guide roll 24 which is rotatably and pivotally mounted at one end by bearing 28. Guide roll 24 is rotatably mounted at its opposite end in a bearing carried in housing 30. Housing 30 receives screw threaded shaft 32 which is rotatably mounted at one end in bearing 32' and is mounted by drive motor 34 at its opposite end. Side frame members 36 support the mounting structure for guide roll 24.

A sensor, which in the instant invention is laser scanner 40, is arranged along the return path of papermaking fabric 14 between the forward idler roll 22 and guide roll 24. Laser scanner 40, is connected with drive motor 34 through controller 46 by suitable circuitry, and is operative to cause motor 34 to rotate in two directions depending upon the amount of light sensed by laser scanner 40.

Figure 7:
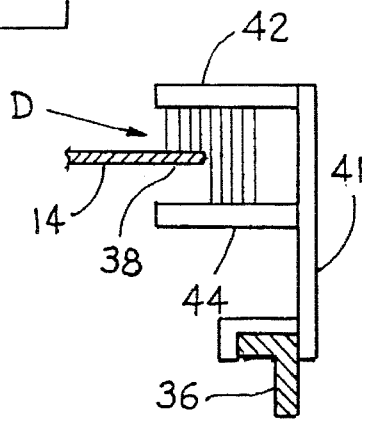
FIG. 7 is a sectional view showing a preferred position of the laser curtain along the edge of the papermaking fabric.

As shown in FIG. 7, laser scanner 40 may adjustably secure to beam 36 by mount 41' and along a longitudinal edge of papermaking fabric 14 with its transmitter or transmitting arm 42 positioned over one surface of the fabric and its receiver or receiving arm 44 positioned over the opposite fabric surface. Transmitter 42 delivers a laser beam or laser screen D having spaced, parallel opposite edges. Receiver 44, which receives the laser screen, is capable of detecting the slightest change in the quantity of light. Receiver 44 then develops a change in voltage output indicative of the change in light quantity. Because laser screen D is parallel, minute lateral movement of the fabric edge can be accurately detected.

The preferred sensing unit is the laser scanner LS-3100 series, manufactured by Keyence Corporation of Japan. It is pointed out that the system is not limited to this particular scanner and could function with other suitable type scanning systems.

As shown in FIGS. 1 and 7, edge 38 of fabric 14 is arranged to bisect or pass through laser screen D substantially at its mid point. With edge 38 in this position, a specified quantity of voltage is sent to controller 46. Controller 46 is programmed to be inoperative when receiving this specified quantity of voltage. Should sensed edge 38 move slightly to the right, as seen in FIGS. 1 and 7, the quantity of light received by receiver 44 would increase and receiver 44 would produce a voltage increase indicative of that increase. Movement of edge 38 back to the desired position would cause receiver 44 to resume sending voltage of specified quantity thus de-activating controller 46. Movement of edge 38 to the left of the desired position would initiate a voltage decrease to controller 46 indicative of less light quantity. Laser screen sensor 40 is capable of detecting and responding to minute transverse movements of edge 38 of as little as 5 mm.

The voltage sent by laser scanner 40 and delivered to controller unit 46 by circuitry 45 is converted into a control signal which is transmitted via circuitry 50 to motor 34 and recording unit 48 by circuitry 47.

Depending on the position of edge 38, controller 46 controls motor 34 to move bearing housing 30 along rack 31 via screw 32 either to the right or to the left as viewed in FIG. 5.

Papermaking fabric 14 passes beneath the rearward idler roller 22, upward to and over guide roll 24 and then downwardly to pass under the forward guide roll 24. It is necessary that papermaking fabric 14 engage with guide roll 24 with a minimum wrap of 25° in order that sufficient friction and thus directional control might be imparted to the fabric. A wrap of 25°–35° has been found to produce satisfactory results.

Figure 2:
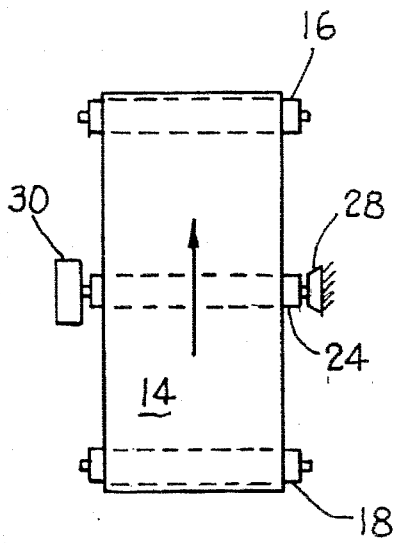
FIGS. 2–4 are diagrammatic top views showing the various positions of the guide roll.
Figure 3:
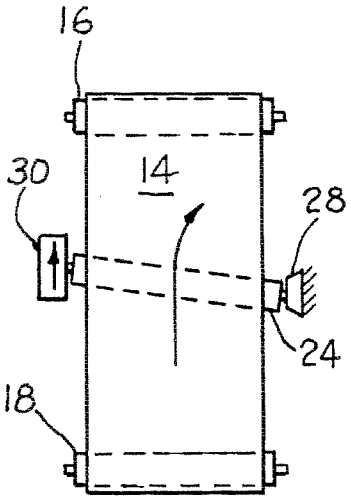
Figure 4:
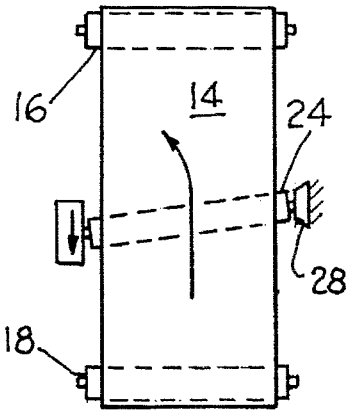

Turning now to FIGS. 2–4, FIG. 2 shows the positions of guide roll 24, front or breast roll 16 and rear or couch roll 18 as being substantially parallel. FIG. 3 shows the position of guide roll 24 relative to front and back rolls 16 and 18 after laser scanner 40 has detected a decrease in light quantity. Bearing housing 30 has been shifted to a forward position by motor 34 causing guide shaft 24 to pivot in bearing 28 as it is moved out of parallel alignment with forward and rear rolls 16, 18 by between 1° and 15°. With guide roll 24 in this position, the longitudinal position of papermaking fabric 14 is transversely shifted to the right along the longitudinal axes of shafts 16 and 18 as indicated by the arrow.

FIG. 4 shows guide roll 24 shifted in a rearward direction to be again out of parallel alignment with front and rear rolls 16 and 18 by between 1° and 15°. In this position, guide roll 24 directs papermaking fabric 14 to shift its longitudinal position to the left transversely of rolls 16 and 18 and in the direction of the arrow.

Referring again to FIG. 5, there can be seen a recording unit 48 connected with control 46 through lead 47. This recording unit is controlled by the edge position sensed by laser sensor 40 and the corresponding signal from control 46 to produce a running tape documenting or plotting the positions of edge 38 during the life of papermaking fabric 14. Alternatively, the recording unit can selectively be activated to record the position of edge 38 during selected operational cycles.

The tape can be used to determine various preferred tensions for differing paper products which allow the papermaking fabric to best perform its functions while uniformly circulating through the papermaking machine. Greater fabric life, more uniform distribution of the paper forming fibers and more even removal of the water are the objectives sought.

In operation, edge 38 bisects laser screen D of laser scanner 40 when the papermaking fabric is positioned in a desired lateral position relative to and is circulating smoothly through papermaking machine A. Should fabric 14 drift to the left or right due to uneven tension, uneven pulp distribution or some other condition, scanner 40 sends a voltage quantity change to control 46 indicative of that movement. Control 46 then converts that quantity of voltage into a control signal which drives motor 34 in the appropriate direction to sufficiently shift housing 30 and guide roll 24 to steer fabric edge 38 back into the desired lateral position within laser screen D. Minute movement of edge 38, as small as 0.0001 mm, is sufficient to be detected by laser scanner 40.

Figure 6:
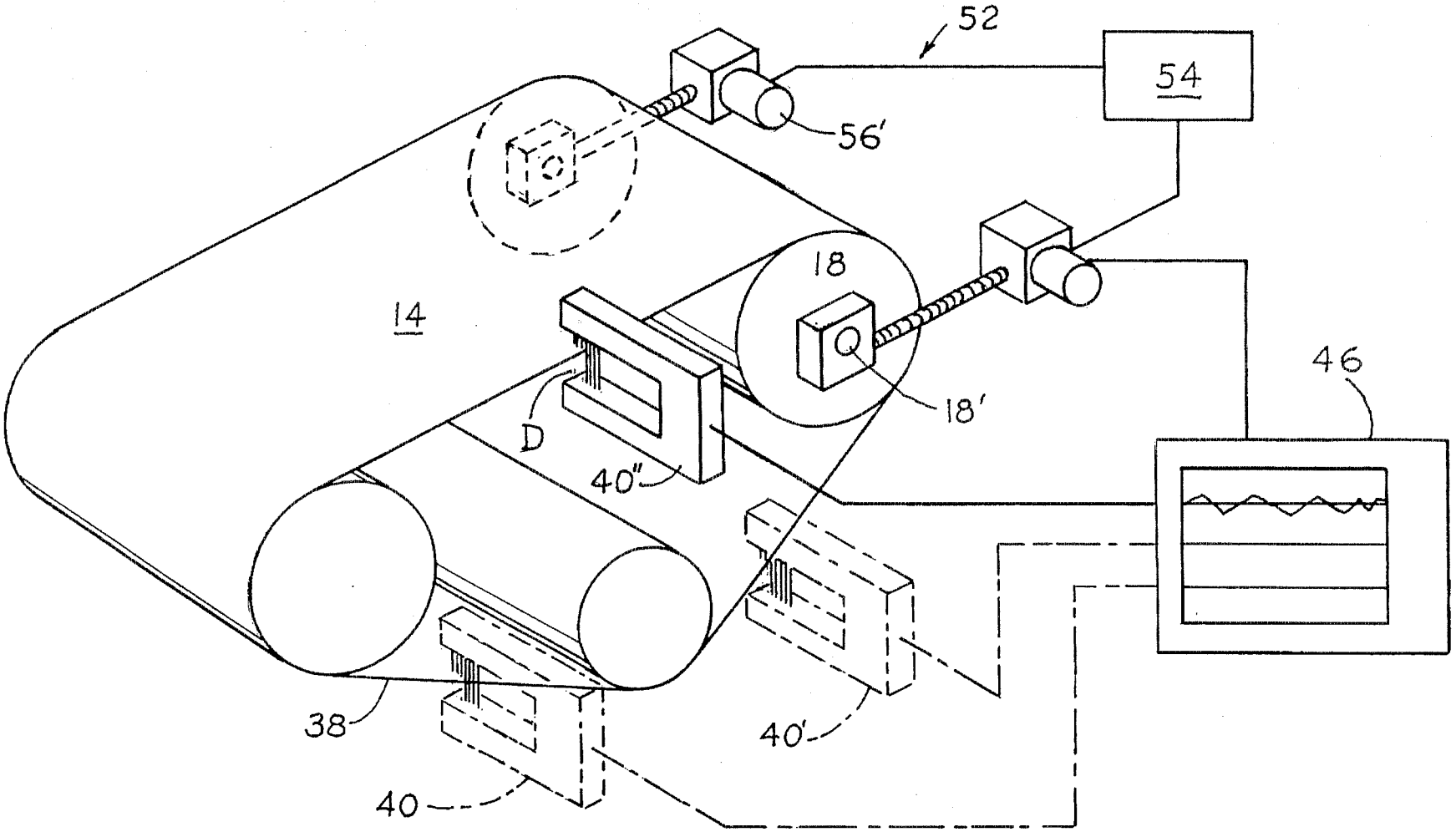
FIG. 6 is a diagrammatic perspective view showing alterative locations for the sensing element and roll guide.

FIG. 6 shows alternative locations for the laser scanner identified as 40, 40' and 40". The figure also shows alternative arrangements for the edge tracking device. Laser scanners 40 and 40' are shown in broken lines indicating alternative locations along the path of papermaking fabric 14. Laser scanner 40" is shown in the area of the dryer section of the papermaking machine.

In the alternative arrangement, rear roll 18 is connected with a tensioning device 52 which includes a pair of drives 56, 56' which are connected with the opposite ends of roll 18 and are controlled by control 54. Drives 56, 56' may be activated to move roll 18 laterally to tension papermaking fabric 14. A control 46 is shown connected with drive 56 and with a laser scanner 40". In operation, laser scanner 40" senses the position of edge 38. Should the edge become misaligned, laser scanner 40" activates control 46 as earlier described. Control 46 then activates drive 56 to move end 18' of roll 18 to re-align its axis in the manner described in FIGS. 2–4. This action steers papermaking fabric 14 back into alignment with a desired lateral position along laser screen D.

While preferred embodiments of the invention have been described using specific terms, such description is for illustrative purposes only, and it is to be understood that changes and variations may be made without departing from the spirit or scope of the following claims.

What is claimed is:

1. An edge tracking apparatus in combination with a papermaking machine having a continuous papermaking fabric circulating therethrough, said tracking apparatus comprising:

a guide roll support structure pivotally mounting a guide roll for rotation about a longitudinal axis; a drive connected with said support structure, said drive being operative to move said support structure to pivot said guide roll;

supporting said continuous papermaking fabric with said guide roll with said fabric contacting said guide roll with a wrap of between 25° and 75°;

a laser scanner arranged to emit a laser screen, said laser screen having a uniform width and being positioned to be interrupted at a selected point substantially midway along said width by a longitudinal edge of said papermaking fabric said laser scanner being operative to continuously monitor the lateral position of said edge during movement of said papermaking fabric through said papermaking machine;

a controller connected with said drive and with said laser scanner, said controller being adapted to receive electrical signals from said laser scanner in response to any movement of said longitudinal fabric edge away from said selected point and to produce control signals in response to said received electrical signals which activate said drive to move said support structure to pivot said guide roll; wherein lateral movement of said fabric edge transversely of said laser screen during circulation of said fabric through said papermaking machine activates said tracking apparatus to cause said guide roll to maintain said longitudinal edge along said selected point.

2. The apparatus of claim 1 wherein said laser scanner includes a transmitter which emits a parallel laser screen and a receiver which receives said parallel laser screen; whereby any change in the quantity of light received by said receiver causes said scanner to produce a corresponding control output.

3. The apparatus of claim 1 wherein said laser scanner includes a transmitter for transmitting said laser screen and a receiver for receiving said laser screen, said laser scanner being operative to initiate movement of said guide roll in a first direction upon said receiver sensing an increase in light quantity and to initiate movement of said guide roll in an opposite second direction upon sensing a decrease in light quantity.

4. The apparatus of claim 1 wherein said papermaking machine includes a paper forming section arranged between front and rear ends thereof, said continuous papermaking fabric moves from said front end over said papermaking section, to said rear end and returns to said front end along a path beneath said forming section, means mounting said laser scanner along said return path of said papermaking fabric.

5. The apparatus of claim 1 wherein said papermaking machine includes a papermaking section arranged between front and rear ends thereof, said continuous papermaking fabric runs from said front end over said paper forming section, to said rear end and returns to said front end along a path beneath said forming section, said support structure mounting said guide roll along said return path of said papermaking fabric.

6. The apparatus of claim 1 wherein said papermaking machine includes a front end, a rear end and a paper forming section arranged between said front and rear ends, said continuous papermaking fabric runs from said front end over said forming section to said rear end and returns to said front end along a path beneath said forming section, said support structure mounting said guide roll at one of said front and rear ends of said papermaking machine.

7. The apparatus of claim 1 wherein said papermaking machine includes idler rolls, a front end, a rear end and a paper forming section arranged between said front and rear ends, said continuous papermaking fabric moves from said front end over said forming section, to said rear end and returns to said front end along a path beneath said forming section, said idler rolls being mounted along said return path and acting to support and tension said continuous papermaking fabric.

8. The apparatus of claim 7 wherein said guide roll is arranged intermediate of said idler rolls.

9. The apparatus of claim 1 wherein said guide roll support structure comprises a mounting structure pivotally mounting one end of said guide roll and a longitudinally movcable mounting structure mounting an opposite end of said guide roll, said drive connecting with said longitudinally moveable mounting structure; whereby, activation of said drive longitudinally displaces said longitudinally moveable mounting structure.

10. An edge tracking apparatus in combination with a papermaking machine including a frame having a continuous papermaking fabric circulating therethrough, said tracking apparatus comprising:

a laser scanner adapted to constantly sense the lateral position of said papermaking fabric, said laser scanner having a transmitting arm which delivers a laser screen of pre-selected volume said screen having parallel opposed edges and a receiving arm which receives said laser screen and produces an electrical signal in response to the volume of screen received;

a mount mounting said laser scanner with said frame adjacent a longitudinal edge of said fabric with said edge being arranged transverse of said screen and intermediate said parallel edges to interrupt a portion of said screen;

a controller connected with said laser scanner, said controller being operative to produce control signals responsive to electrical signals from said laser scanner;

a steering apparatus, said steering apparatus being connected with and receiving said control signals from said controller, said steering apparatus being operative to maintain said papermaking fabric aligned with said desired lateral position in response to said control signals; whereby, movement of said edge of as little as 0.0001 mm away from a desired lateral position alters sufficiently the volume of said laser screen sensed by said receiving arm to cause said receiving arm to produce and send an electrical signal to said controller indicative of said movement, said controller producing a control signal in response to said electrical signal which activate said steering apparatus.

11. The apparatus of claim 01 further comprising a recording apparatus, means connecting said recording apparatus with said controller, said recording apparatus being operative to plot the lateral position of said edge of said papermaking fabric during operation of said papermaking machine.

12. An edge tracking apparatus in combination with a papermaking machine, said papermaking machine including a plurality rotating support, idler and drive rolls acting to support and circulate a continuous papermaking fabric through said papermaking machine, said support, idler and drive rolls each having an axis of rotation transverse the direction of movement of said continuous paper forming fabric; wherein said tracking apparatus comprises:

an edge sensor comprising a laser scanner having a transmitting arm which delivers a laser screen of pre-selected volume and a receiving arm which receives said laser screen and produces electrical signals in response to the volume of screen received, said laser scanner being arranged adjacent a longitudinal edge of said papermaking fabric, said laser scanner being operative to continuously monitor said moving edge of said papermaking fabric to detect lateral position changes of said longitudinal edge relative to a desired lateral position during movement of said continuous papermaking fabric through said papermaking machine, said transmitting arm generating laser screens of varying volume depending upon the position of said longitudinal edge relative to said desired lateral position;

a guide roll over which said papermaking fabric passes;

a guide roll mounting structure mounting said guide roll for angular displacement and a drive selectively operable to displace said guide roll relative to said mounting structure;

a recording unit operative to record the linear position of said longitudinal edge during movement of said continuous paper forming fabric through said papermaking machine:

a controller, said controller being operative to receive said electrical signals generated by said receiving arm and to produce control signals operative to activate said drive to displace said guide roll to steer said longitudinal edge through minute longitudinal positions and into alignment with said desired lateral position, said controller further producing second control signals in response to said electrical signals to activate said recording unit to graphically plot the positions of said longitudinal edge relative to said desired lateral position during movement of said paper forming fabric through said papermaking machine; wherein, said edge tracking apparatus acts to simultaneously maintain said edge aligned with said desired lateral position and plot the position of said edge during operation of said papermaking machine.

13. The apparatus of claim 12 wherein said edge sensor is a laser scanner which emits a laser screen having parallel edges and said desired lateral position locates said longitudinal edge along an intermediate point between said edges.

14. An edge tracking apparatus in combination with a papermaking machine, said papermaking machine including a plurality of rotating support, idler and drive rolls acting to support and circulate a continuous paper forming fabric through said papermaking machine, said support, idler and drive rolls each having an axis of rotation transverse the direction of movement of said continuous paper forming fabric, wherein said tracking apparatus comprises:

a laser scanner adapted to constantly sense the lateral position of said papermaking fabric, said laser scanner having a transmitting arm which delivers a laser screen of preselected volume and a receiving arm which receives said laser screen and produces an electrical signal in response to the volume of screen received;

a recording unit, said recording unit being operative to plot the linear position of said longitudinal edge during movement of said continuous papermaking fabric through said papermaking machine;

a controller, said controller being operative to receive said electrical signals from said laser scanner said controller being operative to produce and send control signals responsible to said electrical signals which are operative to control said recording unit; whereby, said tracking apparatus records transverse movements of said longitudinal edge during movement of said papermaking fabric through said papermaking machine.

* * * * *